US005244466A

United States Patent [19]

Litz et al.

[11] Patent Number: 5,244,466

[45] Date of Patent: Sep. 14, 1993

[54] OXYGEN BLEACHING OF TEXTILES

[75] Inventors: Lawrence M. Litz, Pleasantville; Thomas J. Bergman, Jr., Valley Cottage, both of N.Y.

[73] Assignee: Praxair Technology, Inc., Danbury, Conn.

[21] Appl. No.: 110,842

[22] Filed: Oct. 21, 1987

[51] Int. Cl.[5] ..... D06L 3/02

[52] U.S. Cl. ..... 8/111; 8/101; 8/110

[58] Field of Search ..... 8/110, 111, 109; 252/186.28, 186.41, 188.21, 186.38, 186.43, 188.2

[56] References Cited

U.S. PATENT DOCUMENTS 2,072,665 2/1937 Campbell et al. ..... 8/111
2,366,740 1/1945 McEwen ..... 8/111

OTHER PUBLICATIONS

"Bleaching Information", IFI Bulletin, TN-103 copyright 1979 International Fabricare Institute.

*Primary Examiner*—Prince Willis, Jr.
*Assistant Examiner*—John F. McNally
*Attorney, Agent, or Firm*—Alvin H. Fritschler

[57] ABSTRACT

Textile bleaching operations are enhanced by passing the cloth being treated alternately between an aqueous hydrogen peroxide solution and an oxygen-containing head space.

38 Claims, 1 Drawing Sheet

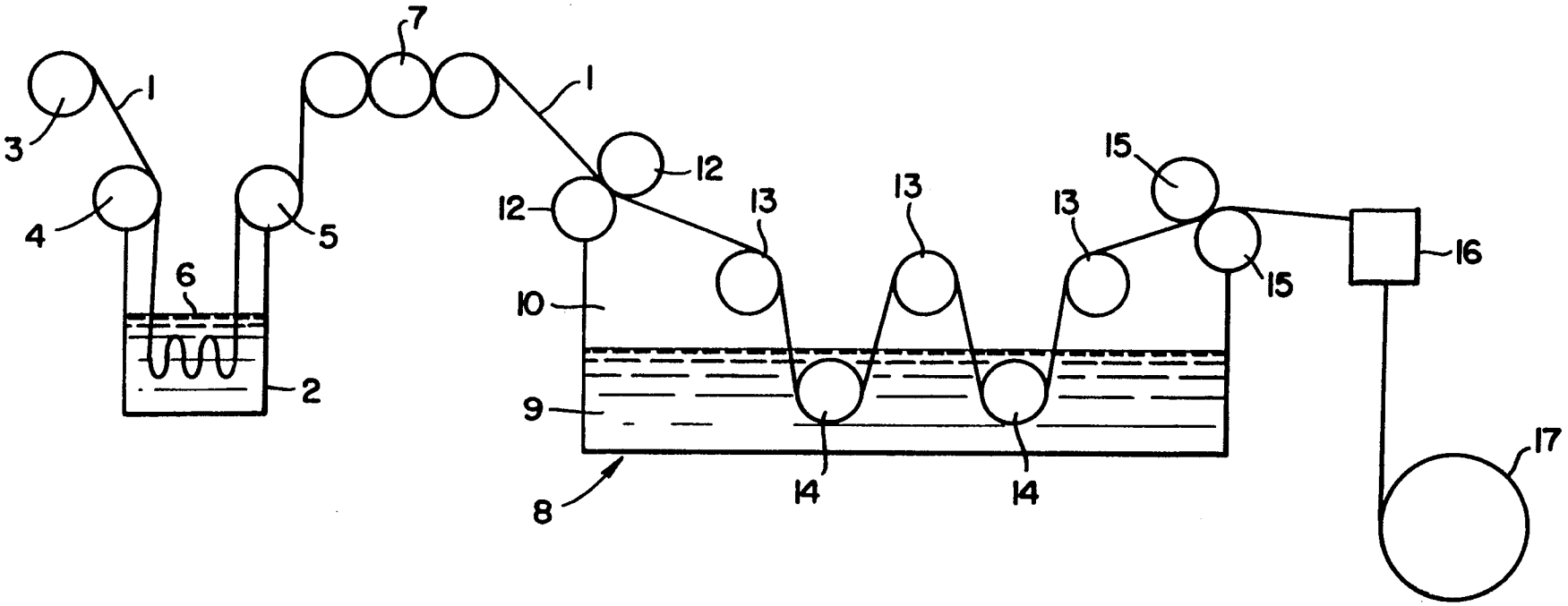
1
2
3
4
5
6
7
8
9
10
12
12
13
13
13
14
14
15
15
16
17

OXYGEN BLEACHING OF TEXTILES

BACKGROUND OF THE INVENTION

1. Field of the Invention

The invention relates to the bleaching of textiles. More particularly, it relates to a process for the carrying out of such textile bleaching in an improved, more economical manner than in conventional processing.

2. Description of the Prior Art

The ability of oxygen to bleach textiles was discovered centuries ago as a result of the exposure of cloth to the ambient environment of air and sunlight. While this type of bleaching action is effective and economical, it is also quite slow and thus unsuited for industrial applications. Modern textile bleaching is generally carried out chemically using hydrogen peroxide as the bleaching agent because of its quick and thorough bleaching or whitening action. However, hydrogen peroxide is also very expensive and tends to degrade very rapidly at the high temperatures necessary for the proper bleaching of textiles.

In a typical textile bleaching plant employing the conventional hydrogen peroxide bleaching process, cloth is first treated with caustic and is then passed into a bleach tank containing a bleaching solution consisting of hydrogen peroxide, water and a stabilizing agent at 37° C. The hydrogen peroxide concentration is typically about 1.5% by weight. The cloth is then passed from the bleach tank through a heater tube in which it is heated to about 90°-99° C. It is then folded into a tortuous shape and passed into a well insulated vessel, referred to as a "J box" because of its typical shape, wherein the desired contact time is provided between the cloth being bleached and the hydrogen peroxide in the bleaching solution. The residence time in the J-box is typically about 60-90 minutes.

As in other industrial processing operations, there is always a desire in the art for improvements in such conventional textile bleaching operations. This is particularly the case because of the cost and degradation characteristics of the hydrogen peroxide bleaching agent. While other bleaching agents are known in the art, hydrogen peroxide is generally preferred, despite such disadvantages, because of its highly advantageous bleaching properties and because alternative bleaching agents likewise have economic and processing disadvantages.

It is an object of the invention, therefore, to provide an improved process for the bleaching of textiles with hydrogen peroxide.

It is another object of the invention to provide a process in which the hydrogen peroxide bleaching of textiles can be carried out in a more efficient and effective manner.

With these and other objects in mind, the invention is hereinafter described in detail, the novel features thereof being particularly pointed out in the appended claims.

SUMMARY OF THE INVENTION

The amount of hydrogen peroxide required for textile bleaching is reduced by passing the cloth to be bleached alternately between an aqueous hydrogen peroxide solution and an oxygen-containing head space.

BRIEF DESCRIPTION OF THE DRAWING

The invention is hereinafter described in detail with reference to the accompanying single FIGURE drawing, which is a schematic illustration of the apparatus used in the practice of an embodiment of the invention.

DETAILED DESCRIPTION OF THE INVENTION

The objects of the invention are accomplished by the use of an oxygen bleaching operation, in conjunction with hydrogen peroxide bleaching, to substantially reduce the costs of the overall bleaching operation. The invention not only enables the amount of hydrogen peroxide employed to be reduced significantly, but also requires less processing equipment than that employed in the conventional hydrogen peroxide process. Thus, the J-box, the bleach tank and the heater tube of conventional practice are eliminated in favor of a single bleaching vessel in the practice of the invention. In addition, the residence times employed in the practice of the invention are generally much lower than those required for conventional hydrogen peroxide textile bleaching.

As used herein, the term "oxygen textile bleaching" is used to denote the process in which, in accordance with the practice of the invention, the cloth to be bleached is alternately passed between hydrogen peroxide and an oxygen containing head space. It will be appreciated that oxygen is much less expensive than hydrogen peroxide, so that the savings in hydrogen peroxide consumption achieved in the practice of the invention renders the oxygen textile bleaching approach more economical to operate than the conventional hydrogen peroxide approach.

Referring to the drawing, the cloth to be bleached, represented generally by the numeral 1, is passed into and out of a caustic solution containing vessel 2 through the use of suitable rollers 3, 4 and 5, with the cloth passing below liquid level 6 in said vessel for desired immersion in the caustic solution. Cloth 1, upon such treatment with caustic, is passed through a series of squeeze rollers 7 for partial drying, it being understood that such processing sequence is generally the same as in conventional hydrogen peroxide processing. Rather than passing from the squeeze rollers through the bleach tank, heater tube, J-tube sequence of the conventional process, cloth 1 leaving squeeze rollers 7 in the practice of the oxygen textile bleaching process of the invention is passed to an essentially gas tight bleaching vessel 8, which contains aqueous hydrogen peroxide solution 9 at a desired concentration and an oxygen containing gas space 10, with the numeral 11 representing the gas liquid interface between said oxygen-containing gas space and said aqueous hydrogen peroxide within vessel 8.

Cloth 1 being treated enters vessel 8 through a pair of essentially gas-tight rollers 12, or a slit or some other suitable essentially gas-tight opening in said bleaching vessel 8. Within vessel 8, cloth 1 passes alternately through a series of rollers 13 and 14. Rollers 13 are positioned so as to pass cloth 1 through oxygen-containing head space 10 within vessel 8. Rollers 14 are submerged below gas liquid interface 11 so as to pass cloth 1 through aqueous hydrogen peroxide 9 within vessel 8. By the alternate arrangement of rollers 13 and 14, therefore, cloth 1 is alternately passed between the aqueous hydrogen peroxide solution 9 and oxygen containing head space 10, with such alternate passing of the cloth through said separate portions of bleaching vessel 8 comprising the oxygen textile bleaching process of the invention.

In the illustrated embodiment of the invention, cloth 1 is shown leaving bleaching vessel 8 through essentially gas-tight rollers 15 or other essentially gas-tight opening for passage to a suitable rinse and dry zone 16 before being passed to collection roller 17 for storage and subsequent distribution, processing and use. Such processing subsequent to treatment of cloth 1 in bleaching vessel 8 will be understood to be essentially as in conventional hydrogen peroxide processing.

Those skilled in the art will appreciate that various changes and modifications can be made in the details of the process and apparatus for oxygen textile bleaching, as herein described, without departing from the scope of the invention as set forth in the appended claims. Thus, while the drawing illustrates three rollers 13 positioned in oxygen containing head space 10 and two rollers 14 positioned in aqueous hydrogen peroxide solution 9, the number of such rollers employed in any particular application shall be determined by the desired residence time within vessel 8, and the number of times that cloth 1 should be dipped into the hydrogen peroxide solution, or passed alternately through said hydrogen peroxide solution and oxygen containing head space sequence for the desired level of bleaching of a given textile material. The cloth, in any event for purposes of the invention, should be treated at least once after immersion in a hydrogen peroxide solution. In preferred embodiments, the cloth is passed through the oxygen containing atmosphere before and after at least one such immersion in the hydrogen peroxide solution. While the illustrated embodiment shows cloth 1 passing initially into oxygen-containing head space 10 before passage into hydrogen peroxide bleaching solution 9, and passing through said oxygen containing head space 10 for discharge from vessel 8, it will be appreciated that any other inlet and discharge arrangement can be employed so long as the cloth being bleached is subjected to the desired number of alternate contacts with aqueous hydrogen peroxide solution and with the oxygen-containing head space for a given application.

While rollers 14 are illustrated as being fully submerged in aqueous hydrogen peroxide solution 9, and rollers 13 are similarly positioned as being entirely within gas space 10, it will be appreciated that such rollers can be positioned in any convenient manner so as to achieve the desired alternate processing of the cloth being bleached. Thus, rollers 14 need not be completely submerged below gas-liquid interface 11, so long as the desired passage of the cloth into the aqueous hydrogen peroxide solution 9 is achieved. In this regard, it should be noted that the liquid level is typically quite low in the practice of the invention, with said gas liquid interface 11 generally being up to about the top of rollers 14 in preferred embodiments of the invention. It should be understood, however, that it is not necessary to employ the roller box arrangement discussed above. It is within the scope of the invention to employ any suitable apparatus wherein the cloth being treated is alternately passed between hydrogen peroxide and an oxygen-containing gas space, with at least one, and preferably two or more, such passes depending upon the residence time desired and the other factors pertaining to a given application.

The operating conditions employed in the practice of the invention can be varied depending upon the particular textile cloth being processed, the degree of bleaching desired, and various other factors pertaining to the overall technical and economic requirements of a particular bleaching operation. Thus, in some instances, the practice of the invention as a more economical alternative to the conventional hydrogen peroxide bleaching may be of paramount importance, with the savings in hydrogen peroxide costs, reduction in capital costs and reduced residence times obtainable in the practice of the invention being desired. In other applications, however, the alternate processing sequence of the invention may be used to achieve a desirable overall bleaching result more favorable than that obtainable by conventional processing, even though each of the various potential areas of improvement, i.e., hydrogen peroxide savings, capital cost reduction and/or residence time reduction, are not utilized so as to maximize the benefits obtainable in each such area for a given bleaching operation.

The cloth processed in the practice of the invention will be understood to include any textile material that can be effectively bleached by the conventional hydrogen peroxide bleaching approach. On the order of about 90% of all cotton fabrics are presently bleached by the use of hydrogen peroxide. Other bleaching agents that are sometimes employed, for particular bleaching applications, include sodium chlorite, sodium hypochlorite and peracetic acid. The advantage of using hydrogen peroxide over the other known bleaching agents is that hydrogen peroxide does not react with proteins in the fiber of the fabric. While the invention is described and claimed herein with respect to the reduction in the amount of hydrogen peroxide employed for bleaching purposes, it should also be noted that satisfactory bleaching action can also be achieved, in some applications, by contacting the textile cloth being treated with pure oxygen or oxygen enriched air following initial immersion or other wetting with caustic, without immersion of the cloth in hydrogen peroxide at all. It should also be appreciated that the practice of the invention in its various embodiments, involving the contact of the cloth with an oxygen containing atmosphere, may enable an acceptable level of bleaching action to be achieved with respect to various textile materials that may not be satisfactorily bleached by the conventional hydrogen peroxide bleaching process.

As described with respect to the illustrated embodiment, the treatment of cottons with bleaching agent solutions, typically aqueous solutions, usually begins with the rolling of the cloth into a caustic containing vessel where it is contacted with caustic, typically 4% NaOH, at about 70° C. for preliminary desizing purposes. It will be appreciated that, in the bleaching of particular textile materials, it may not be necessary to employ such caustic desizing step prior to the actual bleaching step.

Residence times of cloth within the bleaching vessel of the invention will range from about 30 to about 90 minutes, depending on the desired extent of bleaching, the textile being bleached, the hydrogen peroxide concentration employed, the liquid level of the hydrogen peroxide and the ratio of the residence time in the hydrogen peroxide solution and in the oxygen containing head space in each alternate sequence and/or in the overall passage of the cloth being treated through the bleaching vessel. Thus, the invention, in particular applications, can achieve a significant reduction in residence time as compared to conventional hydrogen peroxide processing. While optional cloth residence times of about 60 minutes have been observed in certain experimental embodiments of the invention, it will be understood that the factors referred to above, and the particular configuration of the apparatus employed in practical commercial applications, will result in variations and optimizations with respect to residence time and other operating factors, such as the hydrogen peroxide concentration and the operating temperatures employed.

The hydrogen peroxide concentration employed in the practice of the invention can be at the levels employed for conventional hydrogen peroxide bleaching, i.e. typically about 1.5% by weight or more, but are preferably significantly lower depending on the overall factors pertaining to a given application. Thus, aqueous hydrogen peroxide solutions having hydrogen peroxide concentrations as low as about 0.1% by weight, or less, can be employed in the oxygen textile bleaching process and apparatus of the invention. Concentrations of less than 1.5% and down to about 0.1% are generally preferred.

It was noted above that hydrogen peroxide degrades rapidly at the high temperatures necessary for the proper bleaching of textiles, that is, at the 90°-99° C. level used in the conventional hydrogen peroxide bleaching approach. In the oxygen bleaching process of the invention, lower temperatures can be employed in some embodiments, depending upon the other factors pertaining thereto. Thus, both the hydrogen peroxide and the oxygen containing gas employed in the bleaching vessel may be heated to from about 70° C. to about 100 ° C., preferably from about 70° C. to about 90° C., although temperatures outside this range may also be employed in particular applications. For example, it is possible to cool the hydrogen peroxide solution to maintain a lower temperature, e.g. from below said 70° C. down to lower ambient temperature levels to minimize the degradation of said hydrogen peroxide, while heating the oxygen containing gas space to said 70° C. to 100° C. range to accelerate the bleaching action of the process. Such practice will be understood to be particularly convenient and desirable in larger scale bleaching operations in which conventional heat exchangers, cooling coils and the like can be employed in conjunction with the bleaching vessel to maintain such different temperature levels in the separate sections of the vessel. It will be seen, therefore, that the alternate hydrogen peroxide oxygen treatment of the invention provides an opportunity for further processing advantage through the use of such lower hydrogen peroxide operating temperatures than those necessarily employed in conventional hydrogen peroxide bleaching operations.

It is within the scope of the invention to employ oxygen in any convenient form in the oxygen containing head space within the bleaching vessel. Thus, essentially pure oxygen may be used, and is generally preferred, but air or another suitable oxygen-containing gas may be employed. At least about 35% oxygen, as can be produced, for example, in permeable membranes, is desirable in certain applications. It will be appreciated that, if air rather than high purity oxygen is employed, the gas-tight rollers, or other form of gas tight openings, at the inlet and discharge end of the bleaching vessel are not necessary, but may be employed to assure against any undesired discharge of vapor from the vessel.

The invention is further described herein with reference to illustrative examples thereof. It will be understood that such examples are presented for such illustrative purposes only, and should not be construed as limiting the scope of the invention as set forth in the appended claims.

EXAMPLE 1

In a series of laboratory tests, cotton cloth was manually raised and lowered between the hydrogen peroxide solution and the oxygen gas space in a bleaching vessel. The aqueous hydrogen peroxide solution comprised hydrogen peroxide at desired concentrations, with sodium silicate employed as a conventional stabilizing agent at a concentration of 1.2% by weight and the balance distilled water. An operating temperature of 190° F. (88° C.) was employed throughout. The bleached cloth was analyzed using a modified spectrophotometer to measure its reflectivity, which determines the brightness of the cloth. The tests showed that the hydrogen peroxide concentration necessary to achieve satisfactory commercial bleaching results could be reduced from conventional 1.5% level to 0.5% by the use of the alternate processing of the invention in which an oxygen containing gas, i.e. air, space is employed. Tests were also carried out in which it was determined that the residence time of the cloth within the bleaching vessel should be at least one hour for this embodiment of the invention, in which each cloth sample was manually raised and lowered into the hydrogen peroxide solution twice after the initial immersion of said cloth. It should also be noted that the hydrogen peroxide, as would be expected, tended to degrade somewhat readily at the elevated temperatures of the test, which were nevertheless lower than the temperatures required for conventional hydrogen peroxide bleaching. The hydrogen peroxide had to be continually renewed, therefore, in order to maintain its bleaching activity.

EXAMPLE 2

A laboratory experiment was performed, as in Example 1 above, except that sodium sulfite, at various concentrations, was added to the hydrogen peroxide solution. Sodium sulfite is known to increase the oxidation potential of oxygen. The concentration of sodium sulfite was varied, in a series of comparative tests, from 0% to 2% by weight of the overall solution. At a 2% level, the inclusion of sodium sulfite in the bleaching solution was found to improve the cloth's brightness by as much as 33%. When employed in the oxygen textile bleaching process and apparatus of the invention, therefore, sodium sulfite serves to significantly enhance the bleaching performance of the invention. The addition of sodium sulfite to the aqueous bleaching solution was also found to help decrease the overall consumption of hydrogen peroxide during the bleaching operation.

In preferred embodiments of the invention, it will be seen that it is desirable to incorporate sodium sulfite to the hydrogen peroxide solution, as a useful oxidation enhancer. For this purpose, such sulfite may be employed in an amount in the range of from about 0.1% to about 4%, preferably from about 1% to about 3%, by weight based on the weight of the overall hydrogen peroxide solution, although quantities outside this range may also be employed.

In an alternative to such use of sodium sulfite as an oxidation enhancer, it is within the scope of the invention to add sulfur dioxide to the oxygen containing atmosphere of the invention. For such purpose, the sulfur dioxide is conveniently employed in an amount within the range of from about 0.1% to about 4%, preferably from about 1% to about 3%, by volume based on the overall volume of the oxygen containing head space or other oxygen-containing atmosphere employed in the practice of the invention. It will be understood that quantities outside this range may also be employed, as can combinations of such sodium sulfite and sulfur dioxide, or other oxidation enhancing additives.

In further tests, it was determined that appreciable bleaching action can be achieved by the modification of the invention to the point where the use of hydrogen peroxide is not only significantly reduced, but is eliminated entirely. Thus, cotton cloth, following immersion in caustic as in typical conventional operations, was contacted with a pure oxygen atmosphere, i.e. 99.9+ oxygen, for one hour at about 89° C. This caustic oxygen containing atmosphere treatment resulted in bleaching to the extent of 23% of the fully bleached level of brightness. By contrast, the carrying out of such bleaching action without the use of hydrogen peroxide, with the cloth being immersed in caustic and passed to an oxygen containing atmosphere comprising air for such one hour period at about 89° C., resulted in a bleaching action of less than about 2%. Such treatment by immersion in caustic and exposure to an oxygen containing atmosphere, without immersion in hydrogen peroxide, is thus desirably carried out using an oxygen containing atmosphere of at least about 35% oxygen, as from air separation using permeable membranes, up to the preferable use of a pure or substantially pure oxygen atmosphere. While the level of bleaching achieved thereby is generally less than that achievable in the hydrogen peroxide-oxygen-containing atmosphere sequence of the invention, depending on the operating conditions employed, it will be appreciated that the level of bleaching achievable thereby may be adequate to satisfy the requirements of a particular bleaching operation.

The use of an oxygen containing gas space within the bleaching vessel, and the passing of the cloth alternately between an aqueous hydrogen peroxide solution and said gas space, are found to enhance the effectiveness of the bleaching action so that a significant reduction in the amount of hydrogen peroxide employed can be achieved. This effect, it will be seen from the second example above, can be enhanced by the incorporation of a small amount of sodium sulfite into the hydrogen peroxide solution, $SO_2$ into the oxygen containing head space, or by the use of some other additive capable of increasing the oxidation potential of oxygen. As a result of the practice of the invention, the amount of hydrogen peroxide consumed for a given bleaching operation can be minimized in optimized embodiments of the invention. In general, the oxygen textile bleaching approach of the invention can result, in practical commercial applications, in at least a 25%, and typically more than 50%, reduction in the amount of hydrogen peroxide employed and consumed. As even high-purity oxygen for use in the practice of the invention is far less expensive than the additional amount of hydrogen peroxide otherwise required for conventional hydrogen peroxide bleaching, the invention is clearly less costly to operate than the conventional process. Apart from the additional advantages of potentially lower residence times and lower capital cost requirements, the invention represents a further significant advance in the art in another manner arising out of the ability to reduce the amount of hydrogen peroxide required for suitable bleaching action. A substantial cost associated with bleaching operations is that associated with the spent aqueous hydrogen peroxide removal step. Such spent liquid presents a further problem in that, after removal, it must be either disposed of as waste or recovered for reuse. In the case of disposal of aqueous liquids containing residual bleaching agents, environmental problems are encountered and must be overcome. For the recovery of such aqueous liquids for reuse, elaborate systems must be employed, adding to the expense of the overall treatment operation. By enabling the amount of hydrogen peroxide required to be used in aqueous solutions to be reduced appreciably, the invention provides a further significant advance in the development of the textile bleaching field.

I claim:

1. In the process of bleaching textiles with hydrogen peroxide, the improvement comprising contacting the textile cloth being treated in an oxygen-containing atmosphere having an oxygen concentration ranging from at least about 35 volume percent essentially pure oxygen following immersion in an aqueous hydrogen peroxide solution having a hydrogen peroxide concentration of form about 0.1 to about 1.5% by weight, said hydrogen peroxide solution being maintained at a temperature of from about ambient to about 100° C. and said oxygen-containing atmosphere being heated from 70° C. to about 100° C.

2. The process of claim 1 in which said hydrogen peroxide solution is heated to from about 70° C. to about 100° C.

3. The process of claim 2 in which said hydrogen peroxide solution and said oxygen-containing atmosphere are heated to from about 70° C. to about 90° C.

4. The process of claim 1 in which maintaining said hydrogen peroxide solution at a temperature of from ambient temperature to about 70° C.

5. The process of claim 4 in which said hydrogen peroxide solution is maintained at about ambient temperature.

6. The process of claim 1 in which said oxygen-containing atmosphere comprises essentially pure oxygen.

7. The process of claim 1 in which said oxygen-containing atmosphere comprises about 35% of oxygen by volume.

8. The process of claim 1 in which said cloth being treated is immersed in a caustic solution prior to treatment with said hydrogen peroxide solution and said oxygen-containing atmosphere.

9. The process of claim 1 in which the residence time of the treatment of cloth by said hydrogen peroxide solution and said oxygen-containing atmosphere is from about 30 to about 60 minutes.

10. The process of claim 1 in which said textile cloth comprises cotton cloth.

11. The process of claim 1 in which the textile cloth being treated is immersed in said hydrogen peroxide solution at least twice, said cloth contacting the oxygen-containing atmosphere after each such immersion in aqueous hydrogen peroxide solution.

12. The process of claim 11 in which the total residence time of said process being from about 30 to about 90 minutes.

13. The process of claim 12 in which said hydrogen peroxide solution is heated to from about 70° C. to about 100° C.

14. The process of claim 12 in which said hydrogen peroxide solution is maintained at a temperature of from ambient temperature to about 70° C.

15. The process of claim 12 in which said oxygen-containing atmosphere comprises pure oxygen.

16. The process of claim 1 and including the addition of sodium sulfite to the hydrogen peroxide solution to enhance the oxidation potential of oxygen in said bleaching process.

17. The process of claim 16 in which said sodium sulfite concentration is from about 0.1% to about 4% by weight of the overall solution.

18. The process of claim 1 and including the addition of sulfur dioxide to the oxygen-containing atmosphere to enhance the oxidation potential of oxygen in the bleaching process.

19. The process of claim 18 in which said sulfur dioxide is employed in an amount within the range of about 0.1% to about 4% by volume based on the overall volume of the oxygen-containing atmosphere.

20. The process of claim 19 in which said oxygen-containing atmosphere comprises essentially pure oxygen heated to from about 70° C. to about 90° C.

21. An improved process for the bleaching of textiles comprising continuously passing a strip of textile cloth to be treated into a bleaching vessel containing an aqueous hydrogen peroxide solution having a hydrogen peroxide concentration of from about 0.1 to about 1.5% by weight and an overhead oxygen-containing gas space having an oxygen concentration ranging from at least about 35 volume percent essentially pure oxygen, said cloth being immersed in said hydrogen peroxide solution and being passed into said overhead oxygen-containing gas space following such immersion at least once prior to being passed from the bleaching vessel, said hydrogen peroxide solution being maintained at a temperature of from about ambient to about 100° C. and said oxygen containing-atmosphere being heated to from about 70° C. to about 100° C.

22. The process of claim 21 in which said hydrogen peroxide solution is heated to from about 70° C. to about 100° C.

23. The process of claim 21 in which said strip of cloth being treated is passed into said bleaching vessel in the overhead oxygen-containing gas space, and is then immersed into the hydrogen peroxide solution and withdrawn therefrom into said gas space at least once prior to being passed from said bleaching vessel.

24. The process of claim 23 in which the strip of cloth is alternately immersed into and withdrawn from the hydrogen peroxide solution into the oxygen-containing gas space at least twice prior to being withdrawn from the bleaching vessel.

25. The process of claim 23 in which said aqueous hydrogen peroxide solution and said oxygen-containing atmosphere are heated to from about 70° C. to about 100° C.

26. The process of claim 24 in which the residence time of the cloth being treated within the bleaching vessel is from about 30 to about 90 minutes.

27. The process of claim 24 and including adding sodium sulfite to said aqueous hydrogen peroxide solution.

28. The process of claim 24 in which said oxygen-containing gas space comprises essentially pure oxygen.

29. The process of claim 24 in which said oxygen-containing gas space comprises about 35% oxygen by volume.

30. The process of claim 21 in which said hydrogen peroxide solution and said oxygen-containing atmosphere are heated to from about 70° C. to about 90° C.

31. The process of claim 21, wherein said hydrogen peroxide solution is maintained at a temperature from ambient to about 70° C.

32. The process of claim 21 and including adding sodium sulfite to said hydrogen peroxide solution to enhance the oxidation potential of oxygen in said bleaching process.

33. The process of claim 32 in which the sodium sulfite concentration is from about 1% to about 4% by weight of said solution.

34. The process of claim 21 and including the addition of sulfur dioxide to the oxygen-containing atmosphere to enhance the oxidation potential of oxygen in the bleaching process.

35. The process of claim 34 in which said sulfur dioxide is employed in an amount within the range of from about 0.1% to about 4% by volume based on the overall volume of the oxygen-containing atmosphere.

36. The process of claim 21 in which said strip of cloth enters and leaves said bleaching vessel through essentially gas-tight openings.

37. The process of claim 21 and including passing said strip of cloth through a caustic solution and at least partially drying said cloth before passage into said bleaching vessel.

38. The process of claim 21 and including rinsing and drying said strip of cloth following its removal from said bleaching vessel.

* * * * *